US010448158B2

(12) United States Patent
Fazi et al.

(10) Patent No.: US 10,448,158 B2
(45) Date of Patent: Oct. 15, 2019

(54) SOUND REPRODUCTION SYSTEM

(71) Applicant: UNIVERSITY OF SOUTHAMPTON, Highfield, Southampton Hampshire (GB)

(72) Inventors: Filippo Maria Fazi, Southampton (GB); Marcos Felipe Simón Gálvez, Southampton (GB)

(73) Assignee: University of Southampton, Southampton, Hampshire (GB)

( * ) Notice: Subject to any disclaimer, the term of this patent is extended or adjusted under 35 U.S.C. 154(b) by 0 days.

(21) Appl. No.: 16/084,795

(22) PCT Filed: Mar. 14, 2017

(86) PCT No.: PCT/GB2017/050687
§ 371 (c)(1),
(2) Date: Sep. 13, 2018

(87) PCT Pub. No.: WO2017/158338
PCT Pub. Date: Sep. 21, 2017

(65) Prior Publication Data

US 2019/0090060 A1 Mar. 21, 2019

(30) Foreign Application Priority Data

Mar. 14, 2016 (GB) ..... 1604295.4

(51) Int. Cl.
*H04R 3/12* (2006.01)
*H04S 7/00* (2006.01)
(Continued)

(52) U.S. Cl.
CPC ..... *H04R 3/12* (2013.01); *G10L 21/0224* (2013.01); *H04R 5/02* (2013.01); *H04R 5/04* (2013.01);
(Continued)

(58) Field of Classification Search
CPC .. H04R 2203/12; H04R 3/12; H04R 2420/01; H04R 5/02; H04R 5/04; H04S 7/303; G10L 21/0224
See application file for complete search history.

(56) References Cited

U.S. PATENT DOCUMENTS 6,243,476 B1 6/2001 Gardner
9,124,996 B2 9/2015 Nelson et al.
(Continued)

FOREIGN PATENT DOCUMENTS

EP 2996345 A1 3/2016
WO 2006096959 A1 9/2006
(Continued)

OTHER PUBLICATIONS

Information Disclosure Statement (IDS) Letter Regarding Common Patent Application(s), dated Sep. 28, 2018.
(Continued)

*Primary Examiner* — Regina N Holder
(74) *Attorney, Agent, or Firm* — Tillman Wright, PLLC; James D. Wright; David R. Higgins

(57) ABSTRACT

A sound reproduction system and filter set comprising an array of loudspeakers, comprises a plurality of delay-gain filter elements, and further wherein the filter set comprises a plurality of loudspeaker-specific filter elements (12) which are each associated with different respective speakers of the loudspeaker array, and further comprising a plurality of loudspeaker-independent filter elements (10) which are each common to a plurality of the loudspeakers of the array.

20 Claims, 8 Drawing Sheets

(51) Int. Cl.

| | |
|---|---|
| ***G10L 21/0224*** | (2013.01) |
| ***H04R 5/02*** | (2006.01) |
| ***H04R 5/04*** | (2006.01) |

(52) U.S. Cl.
CPC ..... *H04S 7/303* (2013.01); *H04R 2203/12* (2013.01); *H04S 2420/01* (2013.01)

(56) References Cited

U.S. PATENT DOCUMENTS

| | | | |
|---|---|---|---|
| 2007/0076892 | A1 | 4/2007 | Kim |
| 2008/0101620 | A1 | 5/2008 | Horbach et al. |
| 2008/0201138 | A1 | 8/2008 | Visser et al. |
| 2009/0034764 | A1 | 2/2009 | Ohashi |
| 2010/0150382 | A1 | 6/2010 | Ko et al. |
| 2011/0261973 | A1 | 10/2011 | Nelson et al. |
| 2012/0170762 | A1 | 7/2012 | Kim et al. |

FOREIGN PATENT DOCUMENTS

| | | | |
|---|---|---|---|
| WO | 20110038075 | A2 | 4/2010 |
| WO | 20110038075 | A3 | 8/2010 |
| WO | 2011135283 | A2 | 11/2011 |
| WO | 2012068174 | A2 | 5/2012 |
| WO | 2015108824 | A1 | 7/2015 |
| WO | 2016077317 | A1 | 5/2016 |
| WO | 2017158338 | A1 | 9/2017 |

OTHER PUBLICATIONS

Epain et al., "Active control of sound inside a sphere via control of the acoustic pressure at the boundary surface", Journal of Sound & Vibration, London, GB, LNKD-DOI:10. 1016/ J.JSV., 2006-06.66, vol. 299, No. 3, Oct. 28, 2006, pp. 587-604, XP005735484. ISSN: 0022-460X, p. 588-593; figures 2, 3, 9, 11, pp. 602-603.

Gauthier, P., Berry, A., "Adaptive Wave Field Synthesis for Sound Field Reproduction: Theory, Experiments and Future Perspectives". AES 123rd Convention Paper, 7300, Oct. 8, 2007, XP002586616, New York, p. 2-12; figures 1, 2. 12, 13, pp. 17-19.

Nelson, P., Yoon, S., "Estimation of Acoustic Source Strength by Inverse Methods: Part I, Conditioning of the Inverse Problem", Journal of Sound and Vibration, vol. 233, No. 4, Jan. 1, 2000, pp. 643-668, XP002586618 DOI: doi: 10.1006/jsvi. 1999.2837, the whole document.

International Preliminary Report on Patentability for International Application No. PCT/GB2009/051292, dated Apr. 5, 2011 (7 pages).

Gover, B. et al., "Microphone array measurement system for analysis of directional and spatial variations of sound fields", The Journal of the Acoustical Society of America, American Institute of Physics for the Acoustical Society of America, New York, NY, US. LNKD-DOI:10.1121/1.1508782, vol. 112, No. 5, Nov. 1, 2002, pp. 1980-1991, XP012003132 ISSN: 0001-4966, the whole document.

Parthy, A., Jin, C., Van Schaik, A., "Optimisation of Co-centered Rigid and Open Spherical Microphone Arrays". AES 120th Convention, 6764, May 23, 2006, XP002586617, Paris, p. 1-2.

Gauther, P. et al., "Sound-field reproduction in-room using optimal control techniques: Simulations in the frequency domain a)". The Journal of the Acoustical Society of America, American Institute of Physics for the Acoustical Society of America, New York, NY, US, LNKD-DOI: 10.1121/1.1850032, vol. 117, No. 2, Feb. 1, 2005, pp. 662-678, XP012072769, ISSN: 0001-4966, p. 664-665, figures 1, 2, 17, 18, p. 671-677.

Spors, S. et al., "The Theory of Wave Field Synthesis Revisited" Audio Engineering Society (AES) Convention Paper, New York, NY, US, vol. 124, May 17, 2008, p. 19PP, XP007910177, the whole document.

Buchner, H. et al., "Wave-domain adaptive filtering:acoustic echo cancellation for full-duplex systems based on wave-field synthesis" Acoustics, Speech, and Signal Processing, 2004. Proceedings. (ICASSP '04). IEEE International Conference on Montreal, Quebec, Canada, May 17-24, 2004, Piscataway, NJ, US, IEEE LNKDDOI: 10.1109/ICASSP.2004.1326777, vol. 4, May 17, 2004, pp. 117-120, XP010718419, ISBN:978-0-7803-8484-2, pp. 119-120; figures 1, 2, 4.

"International Search Report" and "Written Opinion" of the International Search Authority (ISA/EP) in University of Southampton, International Patent Application Serial No. PCT/GB2017/050687, dated May 26, 2017 (9 pages).

"Search Report" of the United Kingdom Intellectual Property Office in University of Southampton, United Kingdom Patent Application No. GB 1604295.4, searched Jul. 26, 2016 (1 page).

SOUND REPRODUCTION SYSTEM

CROSS REFERENCE TO RELATED APPLICATIONS

This application is the U.S. national stage application under 35 U.S.C. § 371 of co-pending International Application No. PCT/GB2017/050687, filed Mar. 14, 2017 and designating the U.S., which published as WO 2017/158338 A1 on Sep. 21, 2017, and which claims the benefit of United Kingdom Patent Application No. GB 1604295.4, filed Mar. 14, 2016. Each of the foregoing patent applications and patent application publications is expressly incorporated by reference herein in its entirety.

TECHNICAL FIELD

The present invention relates generally directed to audio and sound reproduction systems, and in particular, although not exclusively, to the generation of 3D sound which is adaptive to the listeners' position.

BACKGROUND

The reproduction of 3D audio has seen significant changes in its delivery to the user. This started with the introduction of multichannel reproduction devices such as the 5.1 loudspeaker systems, which have become only partially popular mainly due to their limited practicality (multiple loudspeakers and cables arranged in the room). Nowadays, the audio consumer market is heading towards the use of more compact solutions such as sound-bars. Evidence of that is provided by the sales figures of these devices, which have increased considerably in the last couple of years. Recently, the home audio market has also seen the introduction of new sound reproduction platforms, such as mobile phones or tablets. Attempts have been made by some manufacturers to produce accessories for these devices to reproduce 3D audio.

Loudspeaker array technology for the reproduction of 3D audio is becoming very attractive, especially because of the decreasing cost of the processing electronics. This allows for the creation of personalized sound zones, in which different users can listen to different audio material without interfering with each other. Additionally, binaural audio reproduced by arrays is likely to become increasingly important in the field of sound reproduction. Binaural audio, initially designed for headphones, is the object of an intense research work carried out by many academic groups, companies, and broadcasters, which are currently developing new solutions and investing in this technology. The reproduction of this audio material with loudspeaker arrays brings the reproduction of 3D audio to another dimension, allowing high audio realism to the consumer.

A number of solutions and proposed ideas for the reproduction of binaural audio through loudspeakers (sometimes also referred to as Transaural audio) are available, as referenced in more detail below. All these systems rely on the use of two or more loudspeakers and of a signal processing apparatus for generating the loudspeaker signals, usually including a network of digital filters to process the input audio signal. Some approaches have been proposed for the adaptive reproduction of binaural audio material, which means that the digital signal processing (DSP) algorithm is adapted depending on the position of the listener(s). These adaptive systems make use of a database of digital filters for a number of predefined listening positions and then select the filters that best match the position of the listener. The drawback of these approaches is that the database of digital filters needs to be pre-calculated and also a carefully tuned signal processing scheme is required to change between the filters associated to different listener positions without compromising the delivered audio quality. Therefore, these systems have a limited operational range, which is given by the size of the grid for which the filters have been created, and their application is limited by the high computational load required for their implementation.

To overcome this limitation in operation range and provide a personal localised; and or binaural reproduction, improved DSP strategies, such as the one disclosed herein, may be implemented.

The concept of a loudspeaker array has existed since the 1940s; however its use for audio applications has not become spread until the 1990s, introducing a paradigm change in PA applications, as much less power was needed to obtain a better distribution of audio over a large audience. In the field of home audio, it has not been until very recently that the use of sound-bars for home cinema applications has become popular. Many of the sound-bars that are now available in the market use traditional array technologies, and although they do provide a higher quality than built-in speakers which are part of many television sets nowadays, their spatial performance is limited.

In order to provide a better spatial audio performance, it is possible to use cross-talk cancellation techniques. A concept firstly introduced by Atal and Schroeder in 1966 [1], cross-talk cancellation for audio reproduction showed itself as an effective idea, however practically limited by the technology available at the time. This was further developed in the 1990s to lead to optimum loudspeaker arrangements as the stereo dipole [2]. In the early 2000s Takeuchi and Nelson presented the concept of the OPSODIS [3], a three way stereo dipole system which ensured to maximise the spatial performance as well as the audio quality.

The use of loudspeaker arrays for cross-talk cancellation has been previously considered by various inventors including Bauck [4], Kuhn et al. [5], Li [6] and Hooley et al. [7], using the same principle as the previously cited patents but with a larger number of loudspeakers.

A drawback of the known cross-talk cancellation reproduction devices however is that they are not adaptive to the position of the listener and constrain the listener to be in the sweet-spot of the sound field. So as to allow the listener to move freely whilst listening to the audio, some systems employ listener tracking, as this for example by Hooley et al. [9]. Another example was presented by Mannerheim et al. [10]. This latter approach works by creating a database of various cross-talk cancellation filters and switching the different (stored and predetermined) filters according to the listener position. Therefore, these filters have to be pre-calculated to account for a large number of potential listener positions, and hence large memory requirements are needed. Apart from this, their performance is constrained by the size of the grid used to calculate the filters and they do not provide an efficient cross-talk cancellation when the listener head is between two grid positions.

We have devised an improved sound reproduction system.

SUMMARY

According to the first aspect of the invention there is provided a sound reproduction system comprising:

an array of loudspeakers, a signal processor arranged to determine input signals to the loudspeaker array, a listener position tracker arranged to sense a listener's or various listeners' instantaneous position relative to the loudspeaker array, the signal processor configured to apply a filter set to a sound recording to be output by the loudspeaker array, so as to determine the loudspeaker input signals, wherein the signal processor further configured to determine updated operational control parameters of the filter set, based at least in part on the instantaneous position of a listener as determined by the listener position tracker, and to adaptively tailor the operational control parameters of the filter set accordingly.

In embodiments of the invention, a reduction in the required signal processing load may be achieved, since it is not required to generate filter elements afresh for each instance of a new listener position, rather it required to calculate updates to the required changes in the operational parameters. This may advantageously result in a reduction in processing load and time.

The invention may be viewed as comprising a loudspeaker array which is controlled by a network of digital filters that are created and adjusted 'on-the-fly' (i.e. in real-time) according to the instantaneous position of one or multiple listeners.

The filter set and the signal processor may be (collectively) implemented by a digital signal processor.

Differently to existing approaches, the signal processing requirements of embodiments of the sound reproduction system may advantageously lower and the underlying processing steps, for example as may be expressed in algorithmic form, are not constrained by the size and resolution of a listener position grid used for the creation of a pre-computed filter database.

The filter set may be viewed as being a substantially fixed or non-variable logical underlying structure or functional architecture, and wherein the signal processor is arranged to be capable of adaptively controlling the control parameters of that logical structure. By logical structure we include reference to the types of filter elements, their functionalities and their arrangement with respect to each other and the loudspeaker array. Preferably, in that context, only or principally, the way in which the filter set acts on the sound recording is varied by way of calculating and implementing the control parameters. In simplified terms this may be thought of as a processor implementing an equation or formula on incoming data, such as sound recording data, and the equation includes a variable, such as a coefficient. The underlying equation/formula remains the same, however, the coefficient is varied during processing of the input data, and therefore the output varies in accordance with the changes made to the coefficient.

The signal processor is preferably arranged to implement changes in operational control parameters of the filter set in real-time. Alternatively, the filter set may be non-adaptive, in that the characteristics (such as the filter coefficients, or other control parameter(s)) are predetermined, for example for a sound reproduction system where the listener or listeners are unlikely to move position relative to the loudspeaker array. However, such an arrangement, although not an (automatic) adaptive through listener position tracking, could be arranged or configured to allow for the filter characters to be updated otherwise, such as by manual intervention, during a calibration or set-up procedure, or otherwise in situations as required.

Implementation of the updated control parameters is preferably arranged to control the operational characteristics of the filter set in respect of the effect of the filter set as applied to the sound recording in generating the loudspeaker input signals.

The signal processor may be arranged to determine a value or a set of values which are used to update the operational parameters of the filter set. The signal processor may be arranged to directly or indirectly determine the updated operational control parameters. The operational control parameters may be viewed as being or comprising filter coefficients. The signal processor may comprise a filter coefficient calculator.

The signal processor may be arranged to determine a measure of new operational parameter or a required change in an operational parameter.

The signal processor may viewed as implementing a sequence of two processing stages or iterations, the first comprising determining updated operational parameters (or measures or values which suitably alter them) of the filter in relation to a sensed change in listener position, and a second being the adaptive control of the filter elements by implementation of the updated operational parameters.

The filter set may comprise or constitute a number of acoustic beam generators, each arranged to control the speakers to output multiple acoustic beams.

It will be appreciated that where the filters may advantageously be realised in the digital domain, in that instance reference to 'filter set' and 'filter elements' may be considered as representing functionalities and processing operations performed by a data processor acting on digitised data. The filter elements of a filter set may be represented and thought of as a logical arrangement or network of functional blocks.

The filter set may comprise a plurality of delay-gain filter elements. The filter set may, in broad terms, be arranged to selectively control the amplitude and/or the phase of sound components output by the respective individual speakers or collective subsets of the speakers of the loudspeaker array. One or more filter elements may be viewed as comprising a gain element and/or a delay element. Adjustable control parameters may include a variable for determining a gain, and/or a variable for determining delay or phase, for the, or each, filter element.

The signal processing operations performed by the filter set may be considered as being divided into speaker specific and speaker non-specific (i.e. common to some or all speakers). This signal processing structure could be viewed as splitting the processing into two stages: a first stage includes a small set of more complex loudspeaker-independent filters, the number of which depends on the number of listeners and not on the number of loudspeakers. A second stage includes as set of simple loudspeaker-dependent filters, which could be as simple as a set of digital delays (and gains). The number of these second-stage filters depends on the number of loudspeakers. An advantage of this approach is that the complexity of the DSP does not increase significantly with the number of loudspeakers because the number of complex loudspeaker-independent filters does not depend on the number of loudspeakers. Put another way, if the number of speakers of a loudspeaker array is increased, the number of speaker-independent filter elements does not increase. This is particular technical advantage since it is the speaker independent filter elements which are more complex as compared to the speaker-dependent filter elements.

The filter set may comprise a plurality of speaker-specific filter elements, each of which may be arranged to be used in control of the input signal for a particular respective speaker. Preferably, the number of speaker-specific filter elements depends on the number of speakers and the number of listeners.

The filter set may comprise a plurality of speaker-independent filter elements, each of which may be arranged to be used in control of the input signal for a subset, or all, of the speakers of the array. Preferably, the number of speaker-independent filter elements is not dependent on the number of speakers, but is dependent on the number listeners.

The filter set may comprise a plurality of speaker-specific filter elements as well as a plurality of speaker non-specific filter elements.

The filter elements may be viewed as forming a distributed filter architecture.

Multiple speaker-specific filter elements may be associated with at least one speaker.

The filter set, or particular filter elements thereof, may be arranged to operate on a frequency dependent basis.

The sound recording may be considered as data representative of audio material.

To highlight advantages of embodiments of the invention, a digital filter can be considered as a sum of, say, N digital operations. This means that an audio digital signal is filtered in blocks of N digital samples. In the context of an adaptive system, this implies that it is not possible to immediately change the control filters, and it is needed to wait until the N samples of one filter are outputted in order to perform any adaptive filter change. In the case of the loudspeaker array, this implies that if a set of control filters are used to control the reproduction in a given listener position and the listener moves to a different position, it will not be possible to adapt the response of the array until the processing of the current filter is completed, which will lead to an inaccurate reproduction for a brief period of time which may be perceptible to the listener. The system may be viewed as avoiding this issue by its decomposition of filter elements into a parallel bank of variable time delay and/or gain filter elements, where previously the required sum in serial fashion of N digital operations this is now effected by a parallel bank of delays. This implies that there is no added time between switching the output of the filter from one listener position to a different listener position, as the gain-delay elements are switched on real-time depending on the listener's or listeners' position. Advantageously, this means that the sound reproduction system is not only able to adapt to changes in listener position, but is able to do so in a highly responsive manner.

The signal processor may be arranged to determine distances from the loudspeakers to the pressure control points at a listener's head.

The loudspeaker array may generally comprise a plurality of individually controllable, or subset controllable, loudspeakers. The loudspeaker array preferably comprises electro-acoustic transducers. The loudspeaker array may comprise a plurality of spatial distributed speakers, which may be distributed along an azimuth. The speakers may be arranged in a side-by-side or adjacent relationship, occupying arranged on a plane.

The sound reproduction system may be viewed as a sound reproduction system which may automatically adapt to changes in listener position.

The system preferably allows for two different modes of operation: one is the reproduction of binaural audio and the second is the reproduction of personalised multi-zone audio, and both modes allowing listeners to move in space and the output of the loudspeaker array is updated to maximise the quality of the reproduction (in the new listener position).

The signal processor may be configured to be operable in a binaural sound reproduction mode. In this mode of operation, in which for the, or each, listener a left listener ear sound beam and a right listener ear beam is caused to be output by the loudspeaker array. This mode may be termed a cross-talk cancellation mode. The respective left and right ear beams may be generated using a filtering approach in which the beam for one ear contributes substantially no or negligible energy at the listener's other ear. In a binaural mode, acoustic beam generators may comprise a set of loudspeaker-independent filters (such as IFs, 10) for example as defined in Eq. 5 and/or a set of loudspeaker-dependent filters per loudspeaker (for example DFs, 12) as defined by Eq. 6.

The signal processor may be configured to be operable in a personalised mode in which for each of multiple listeners acoustic beams are generated which direct different audio to each listener (one beam for each listener) in a respective personalised zone of the sound field. In this mode, acoustic beam generators may be implemented using a set of N speaker-independent filters (such as IFs, 10) as defined by Eq. 5 and/or N loudspeaker-dependent filters per loudspeaker (such as DFs, 12) as defined by Eq. 6. For the case when there is a single listener for the binaural audio mode or two listeners for the personalised audio mode, the loudspeaker-independent filters (such as filters IF10, IF11, IF12, IF21 and IF22, as shown the Figures of this application) may be implemented using equations 7, 8, 9 and 10. The signal processor may be (further) simplified by using a total of N×L loudspeaker-dependent filters. Each of the loudspeaker-dependent filters may conveniently be provided by a single delay or delay and gain filter element.

The signal processor may be arranged to implement any or all of the equations included in the Detailed Description below.

The system may be user-settable to allow a user to select either a binaural mode or a personalised mode of sound reproduction. The system may comprise a user interface to allow mode selection, as well as certain parameters of each mode, such as number of listeners.

The system may also automatically detect the number of listeners and adapt the required reproduction according to the number of listeners.

According to a second aspect of the invention there is provided machine-readable instructions, which, when executed by a data processor, are arranged to implement signal processing of a sound reproduction system such that it is configured to apply a filter set to a sound recording, to be output by a loudspeaker array, so as to determine the loudspeaker input signals, wherein the instructions further configured to determine updated operational control parameters of the filter, based at least in part on the instantaneous position of a listener, or various listeners, as determined by listener position tracking data, and to adaptively tailor the operational control parameters of the filter set accordingly.

The instructions may be stored on a data carrier to be run by a computer (for example a processor chip) or embedded DSP board and/or may be realised as software or firmware.

The invention may include one or features described in the description and/or as shown in the drawings.

BRIEF DESCRIPTION OF THE DRAWINGS

Various embodiments of the invention will now be described, by way of example only, with reference to the following drawings in which.

DETAILED DESCRIPTION

Figure 1:
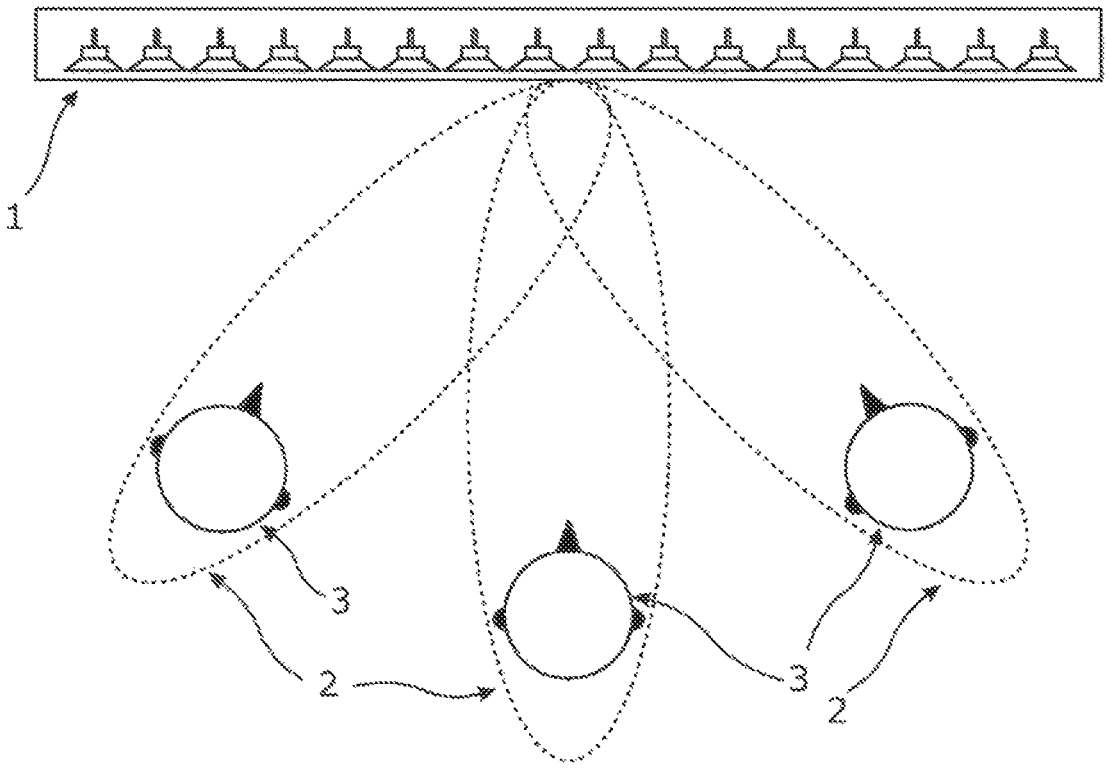
FIG. 1 is a schematic representation of a sound reproduction system operating in a personal audio mode for multiple listeners, in which an audio system capable of generating various audio beams are generated to reproduce various, localised, different audio signals that adjust to the listeners' position.
Figure 2:
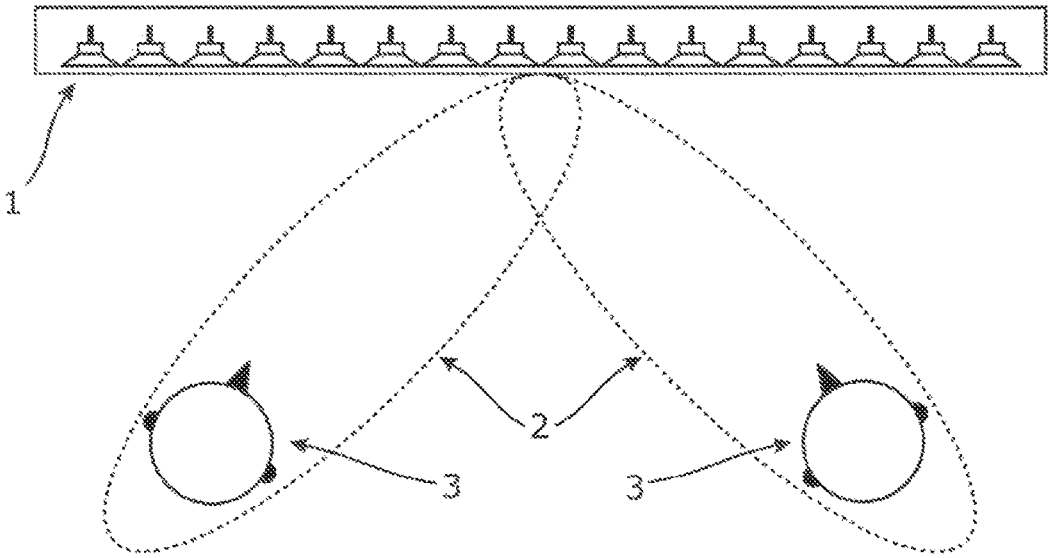
FIG. 2 is a schematic representation of a sound reproduction system operating in a personal audio mode for two listeners which shows an audio system capable of generating two audio beams to reproduce two, localised, different audio signals, that adjusts automatically to listener position.

A sound reproduction system is now described which is operative in two primary modes. In what may be termed a 'personal audio' mode, shown in FIGS. 1 and 2, a loudspeaker array 1 provides a set of targeted beams 2 towards the different users 3. In this mode the beams are created using an inverse filtering approach so that the beam for one listener delivers almost no acoustic energy to the other listener, which is critical to provide convincing audio separation and multi-zone sound reproduction.

Figure 3:
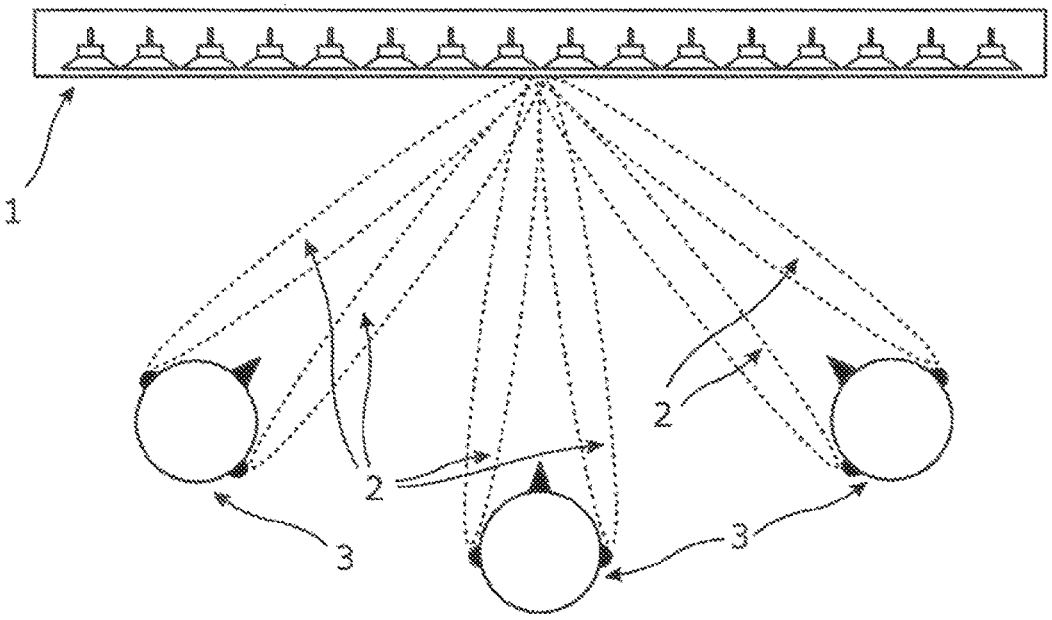
FIG. 3 is a schematic representation of a sound reproduction system operating in a binaural audio mode for multiple listeners which shows an audio system capable of generating multiple pairs of binaural beams to reproduce binaural material to various multiple listeners which automatically adjusts to the listener position.
Figure 4:
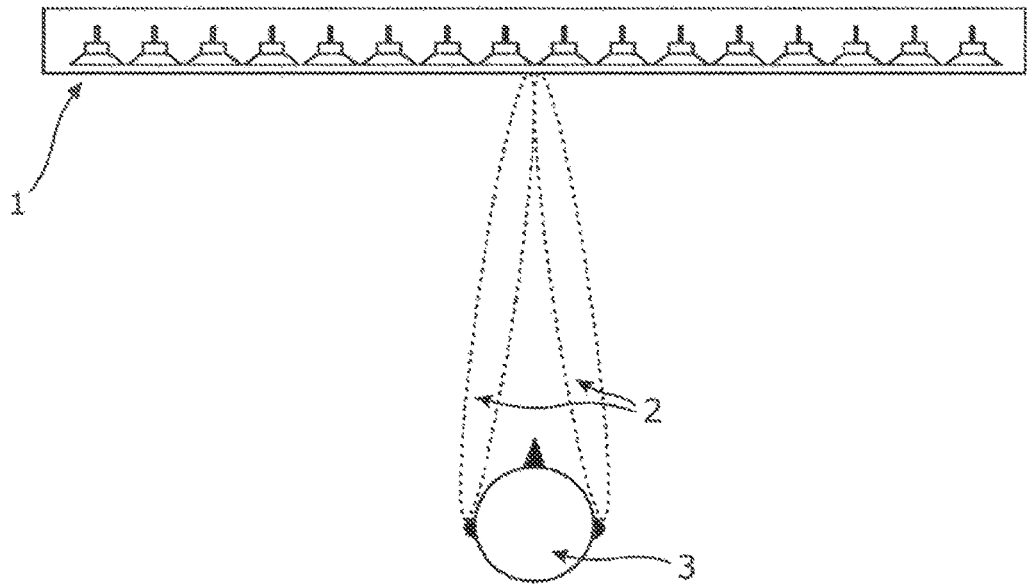
FIG. 4 is a schematic representation of a sound reproduction system operating in a binaural audio mode for a single listener. The Figure illustrates an audio system capable of generating in which two binaural beams are generated to reproduce binaural material for a single system, and the system arranged to adjust automatically to listener position.

The system also works in a second, 'binaural', or cross-talk cancellation mode, which is shown in FIGS. 3 and 4. In this mode the loudspeaker array 1 provides various pairs of targeted beams 2 aimed towards the different listeners' ears 3; a pair of beams for each listener, one beam for the left ear and one beam for the right ear. The beams are created using an inverse filtering approach so that the beam for one ear contributes almost no energy at the user's other ear. This is critical to provide convincing virtual surround sound via binaural signals.

The sound reproduction system comprises a signal processor, such as a data processor, and processing being effected in accordance with machine-readable instructions stored a memory associated with the processor. The signal processor effects this processing in the digital domain.

As will be described below, the sound reproduction system is an adaptive system in which the input signals to the loudspeaker array are controlled in response to a change in a listener's instantaneous position relative to the loudspeaker array.

Figure 5:
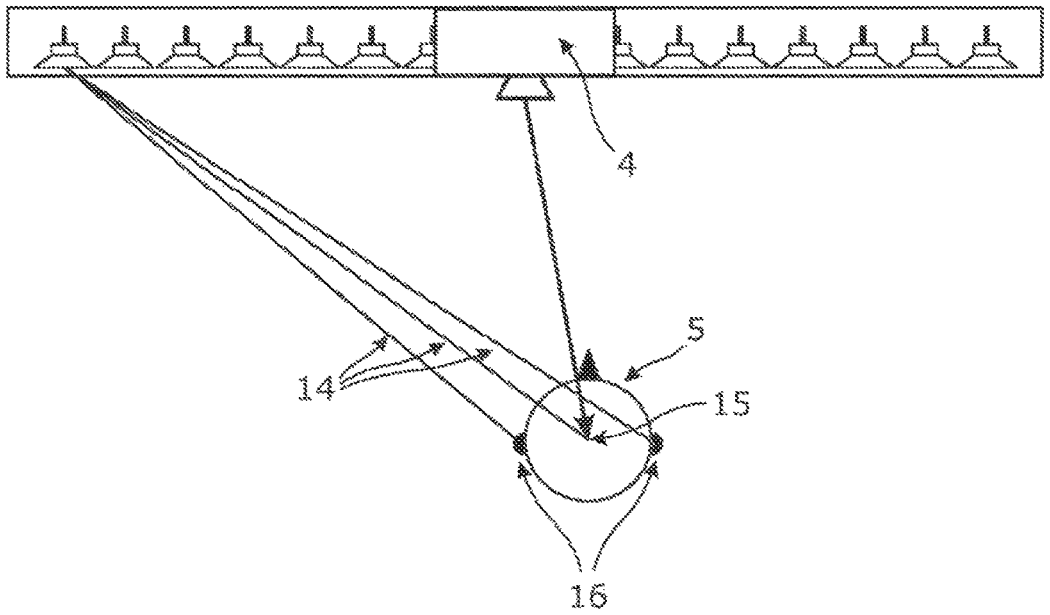
FIG. 5 illustrates the selection of control points depending on the "personal audio" mode or a "binaural" reproduction modes and how the listener tracking device estimates listener position.

The sound reproduction disclosed herein is operable with loudspeaker arrays with an arbitrary number of speaker units, L, and in the same way is able to generate an arbitrary number of beams N for a given number M of listeners in either the 'personal audio' or the 'binaural' mode. The principal difference between the two reproduction modes is how the control points for the creation of the beams are chosen; for the 'personal audio' mode these control points are the centre of the listener's head (or listeners' heads), whilst that for the 'binaural' mode the control points are the listener's (or listeners') ears, as shown in FIG. 5.

For both reproduction modes the control parameters of filters used to control the output of the loudspeaker array are updated in real-time according to the listeners' positions. The listener positional information is obtained in real-time by a listener tracking device 4, which provides the Cartesian coordinates of the listeners' positions 5 for the personal audio mode or of the listener's ears positions for the binaural mode, as shown in FIG. 5. This device can be any kind of suitable device, e.g., a magnetic tracker, a video tracker, a Microsoft Kinect, a mobile phone with GPS, an infra-red tracker, or a remote control held by the listener. The listener position information is fed in real-time to a filter coefficient calculator 6. This block takes the x, y, z position information of each listener 3 and outputs a set of filter coefficients 7. This information is afterwards fed to the different beam generators, BGs, 8), as shown in FIGS. 6*a* and 7*a*, which comprise the array control filters and generate acoustic beams to reproduce the various personalised or binaural signals, as required.

Figure 6:
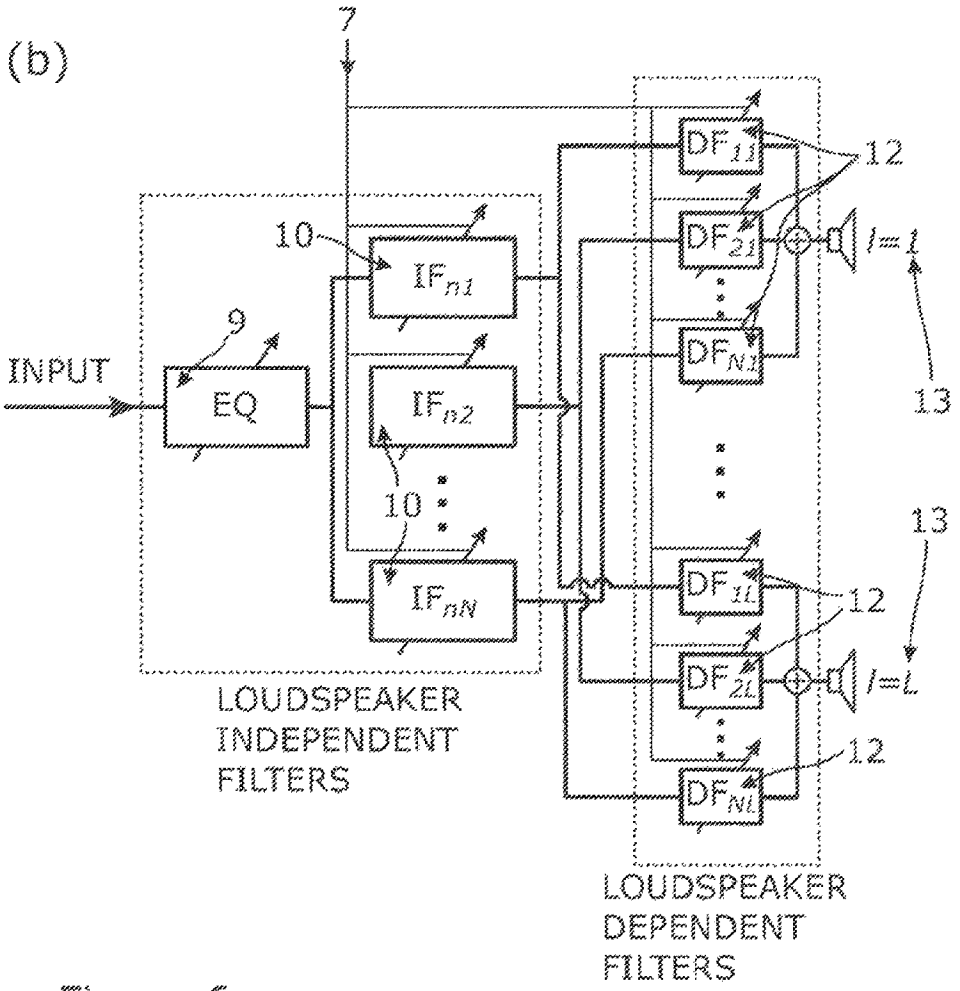
FIG. 6*a* shows a block diagram of digital signal processor (DSP) illustrates the DSP scheme to generate the different audio beams shown in FIGS. 1 and 3, in which, each beam generator (BG) block contains the digital signal processing for creating one of the beams, and the operational parameters of which are modified according to the listener's position provided by a listener tracking device.
FIG. 6*b* illustrates the digital signal processing scheme contained in one of the beam generator (BG) blocks shown in FIG. 6*a*, wherein each block contains a set of loudspeaker-independent filters; and a set of loudspeaker-dependent filters (DFs) needed for each of the loudspeakers of the array.
Figure 6:
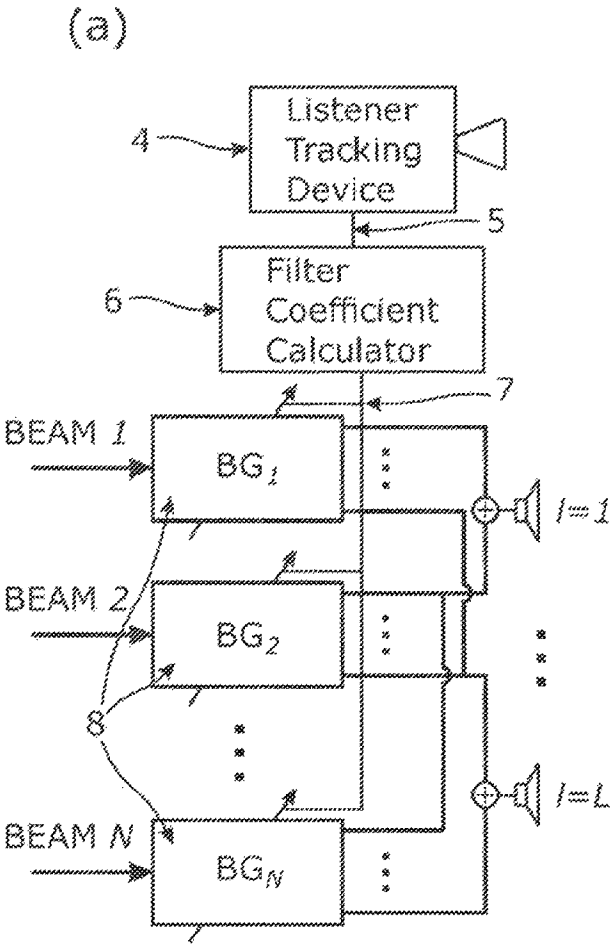

The logical structure of the digital signal processing occurring in each beam generator ((BGs, 8) shown in FIGS. 6*a* and 7*a*) can be observed in FIGS. 6*b* and 7*b*. The instantaneous operational parameters of the beam generators are controlled in real-time by the filter coefficients 7 and comprises a set of loudspeaker-independent filters and a set of loudspeaker-dependent filters. The loudspeaker-independent filters are termed this way because they are common for all the loudspeakers and are formed by an equalisation filter, EQ, 9 and a set of independent filters, IFs, 10. The loudspeaker-dependent filters, DF, 12 are different for each of the array loudspeakers 13.

Figure 9:
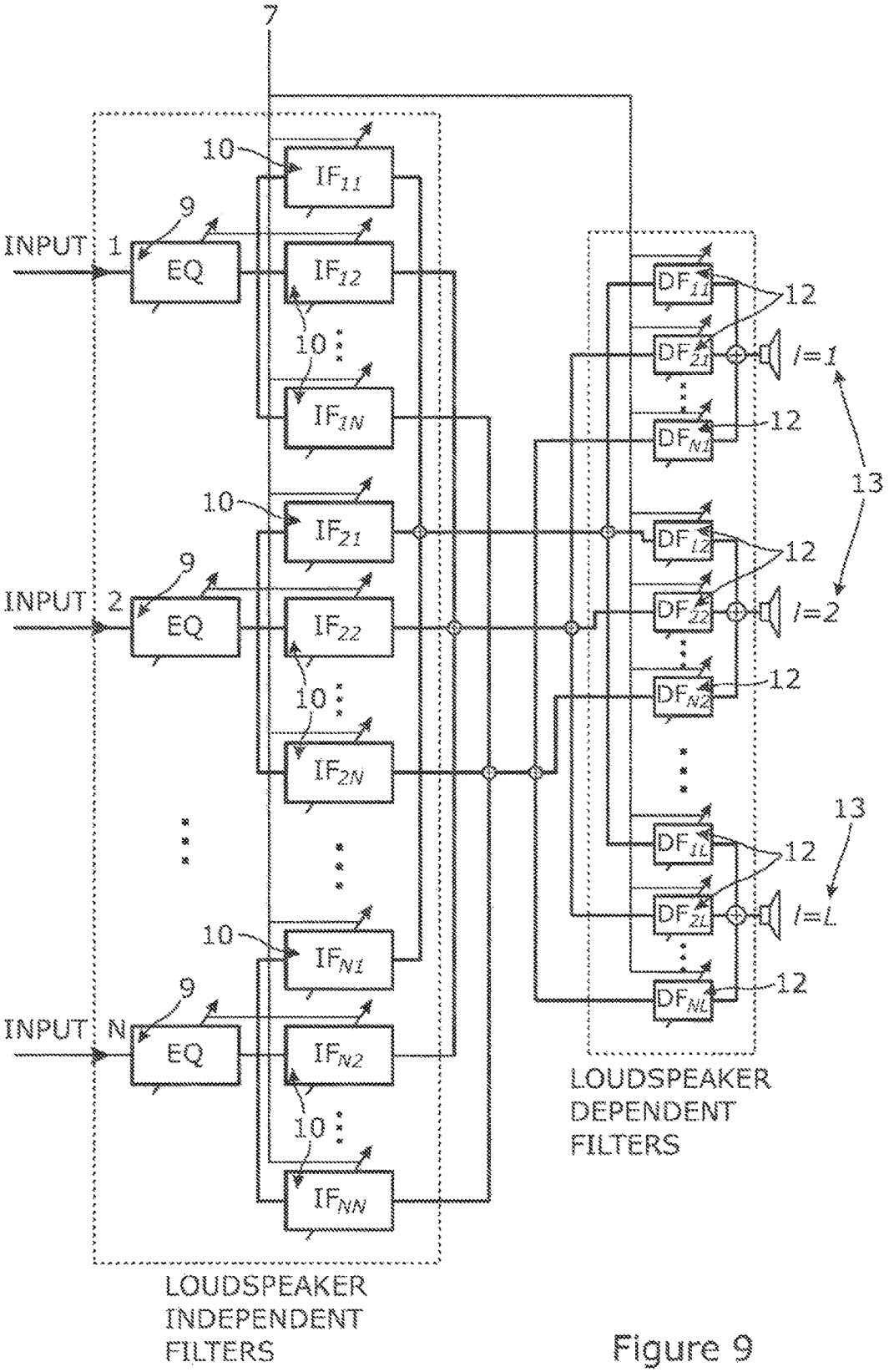
FIG. 9 illustrates a generalised schematic filter set of the invention in which a block diagram of digital signal processor (DSP) illustrates the DSP scheme to generate the different audio beams shown in FIGS. 1 and 3, wherein a set of loudspeaker-independent filters is included for each beam; and a single set of L×N loudspeaker-dependent filters (DFs) is used that is common to all beams.
Figure 10:
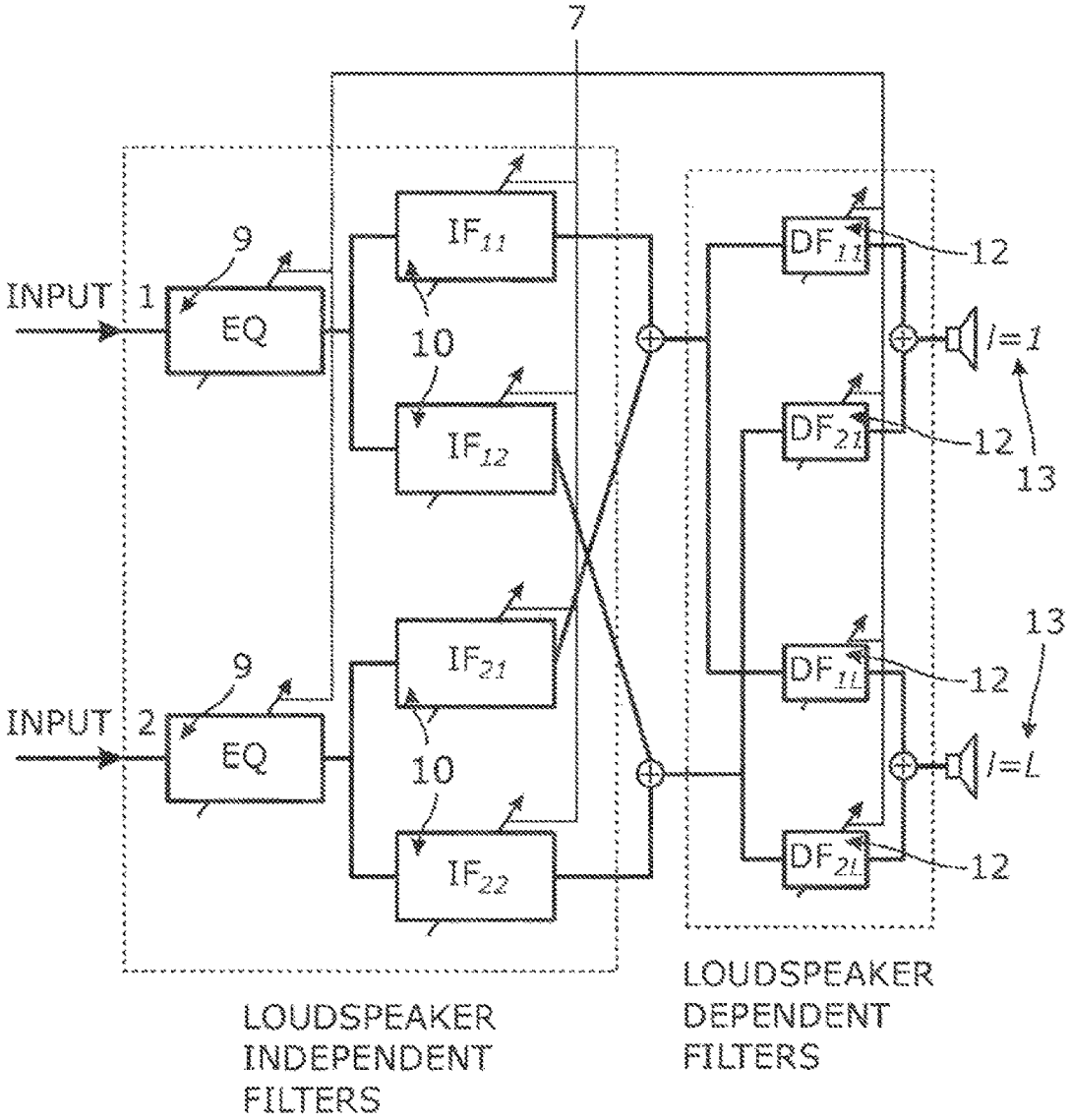
FIG. 10 illustrates a specific implementation of the embodiment of FIG. 9 in which a DSP is illustrated arranged to generate the two audio beams shown in FIGS. 2 and 4, and wherein the total number of loudspeaker-independent filters is here 2L.

Reference is made to FIGS. 9 and 10 which shows an alternative embodiment, but encompassing substantially the same underlying concept. In the filter set shown in FIG. 9, which shows the generalised case in which the signal processing is further simplified by using a set of loudspeaker-dependent filters that is common to all beam generators. This highly advantageously allows a significant reduction in the number of speaker-dependent filter elements required. In FIG. 10, the filter arrangement relates to the specific case of two generated beams, but similarly all loudspeaker-dependent filters are common to both beams.

One aspect of the system is based on the decomposition of a given filter into a set of sparse gain and delay elements. The filters may be created based on pressure-matching or least square inversion, as for example shown in [11, 12], but may also be created following any inverse procedure for sound reproduction. Differently from previous techniques, however, the system can produce in real-time the time-domain coefficients of the filters. This is achieved with determining instantaneous analytical solutions of the underlying inverse problem.

Based on the information provided by the listener tracking device, the filter coefficient calculator 6 estimates the distances 14, $r_{nl}$, from each loudspeaker of the array to the pressure control points, as shown in FIG. 5. The pressure control points are defined by the centre of the listeners' head 15 or by the listeners' ears 16, depending on the sound reproduction mode, either 'personal audio' or 'binaural', respectively.

These distances are afterwards used to form the electro-acoustical transfer functions of the loudspeaker array. These are contained in the matrix C, which has a dimension N×L, where N is the number of control points and L is the number of loudspeakers.

This is written as:

$$C = \begin{bmatrix} c_1 \\ c_2 \\ \vdots \\ c_N \end{bmatrix}. \tag{1}$$

Each element of this matrix is formed assuming a monopole like behaviour of each of the loudspeakers of the array $$c_n = [c_{n1}e^{-jkr_{n1}}, \ldots, c_{nL}e^{-jkr_{nL}}], \tag{2}$$

where $k=\omega/c_0$ is the wavenumber, being $\omega 2\pi f$ the pulsating frequency in rad/s and $c_0$ the speed of sound in air, and $j=\sqrt{-1}$. In this case $c_{nl}=1/r_{nl}$ is an attenuation factor.

The filters, given as a vector H, are defined by an equation of the form $$H = \frac{1}{\det(CC^H + \beta I)} C^H adj\,(CC^H + \beta I)p_T. \tag{3}$$

where 'det' represents the determinant of the matrix $|CC^H+\beta I|$ and 'adj' represents the adjugate matrix. More particularly, the adjugate matrix $(CC^H+\beta I)$represents the loudspeaker-independent filters the transpose matrix $C^H$ represents the loudspeaker-dependent filters the $1/\det(CC^H+\beta I)$represents the equalisation filter Splitting the signal processing into these three separate (logical) groups or elements, corresponding to separate filtering stages, enables a significant simplification of the signal processing, as described above. The magnitude β represents a regularisation parameter used to control the amount of electrical energy used by the filters. The vector $p_T$ is the target pressure vector, used to control the reproduced pressure at the different pressure control points for each of the beams, with a size N×1. The selection of the pressure target vectors is performed according to the control points depicted in FIG. 5. For the personal audio mode this is 1 at the listener positions where the sound pressure level is to be maximised and 0 at the listener positions where the audio signal is to be minimised. For the binaural audio mode this is 1 at the listeners' ear where the pressure is to be maximised and 0 at the listeners' ears where the pressure is to be minimised. The adjugate matrix can be written as $$adj(CC^H + \beta I) = \begin{bmatrix} a_{11}+\beta & a_{12} & \cdots & a_{1N} \\ a_{21} & a_{22}+\beta & \ddots & \vdots \\ \vdots & \ddots & \ddots & \vdots \\ a_{N1} & \cdots & \cdots & a_{NN}+\beta \end{bmatrix}, \tag{4}$$

where each $\alpha_{n,m}$ are the adjugate elements of the matrix.

The adjugate elements, expressed as a summatory of $(N-1)!L^{(N-1)}$ delays, serve to create the loudspeaker-independent filters, IFs, 10 shown in FIGS. 6*b* and 7*b*, and their impulse responses are defined as $$IF_{n,m}(t) = \sum_{b=1}^{(N-1)!L^{(N-1)}} g_{b,n,m}\delta(t - d_{b,n,m} - T), \tag{5}$$

with a total of N loudspeaker-independent filters required per beam, where T is a modelling delay introduced to ensure that the filters are causal. Each filter element expressed in Eq. 5 can be implemented in real-time by a parallel bank of variable delay-gain elements (17, FIG. 8*a*) the coefficients of which, $g_{b,n,m}$ and $d_{b,n,m}$, may be calculated from the adjugate matrix and updated in real-time based on the filter coefficient information (7, FIGS. 6*a* and 7*a*). Alternatively, the filters expressed in Eq. 5 can be implemented as FIR or IIR filters.

The system may include an equalization filter, (EQ, 9), shown in FIGS. 6*b* and 7*b*. This filter can be implemented as an FIR or an IIR. The coefficients of the equalisation filter may be calculated from the determinant, det $(CC^H+\beta I)$, and can be updated in real-time depending on the listener position.

Figure 7:
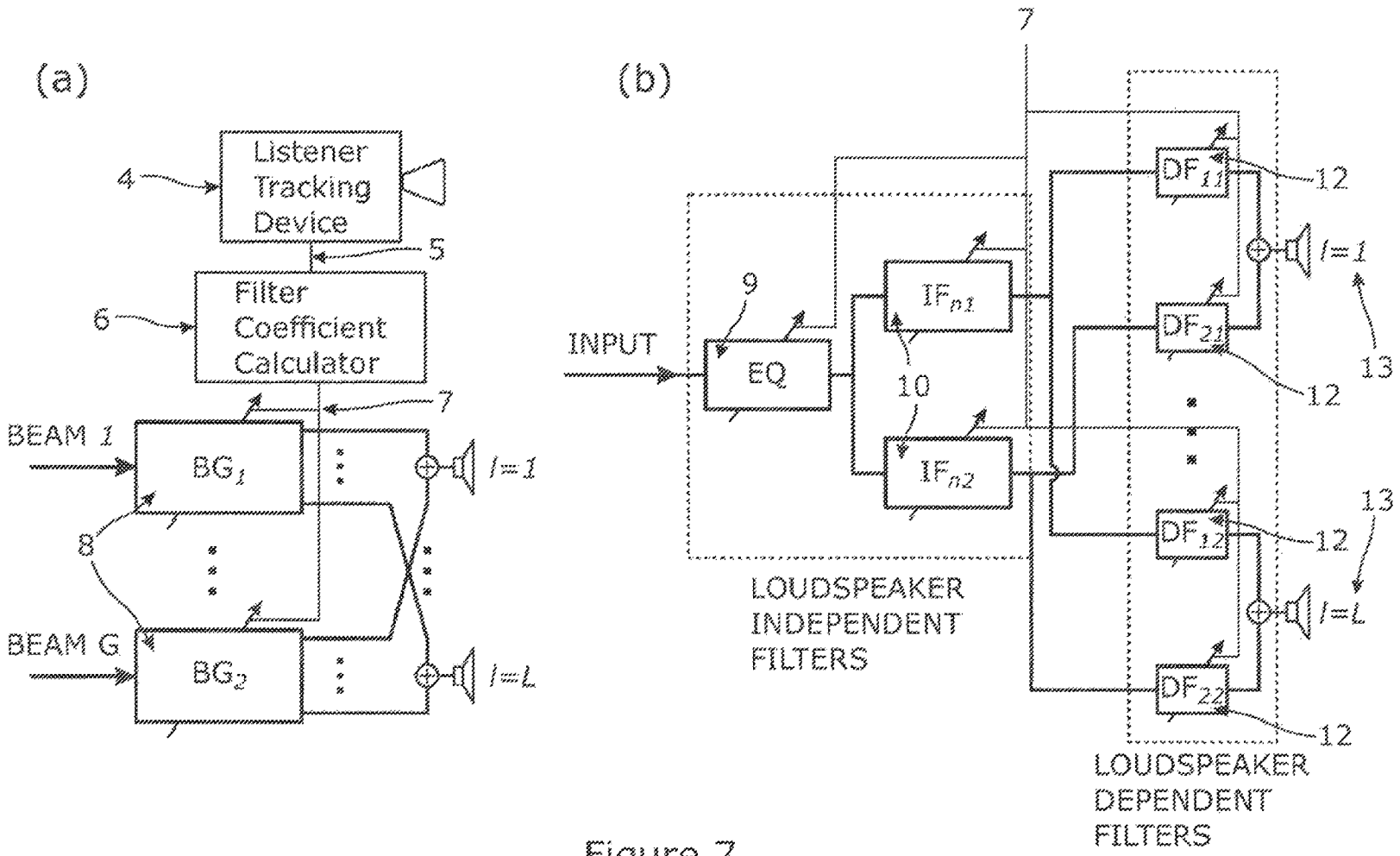
FIG. 7*a* illustrates the process to generate the two audio beams shown in FIGS. 2 and 4. Each beam generator (BG) block contains the digital signal processing for creating one of the beams, and is modified according to the listener position provided by a listener tracking device. (Note that this is a special case of the DSP scheme illustrated in FIG. 6*a*.)
FIG. 7*b* illustrates the digital signal processing contained in one of the BG blocks shown in FIG. 7*a*, in which each block contains a set of loudspeaker-independent filters; these are an equalisation filter (EQ) and a set of two loudspeaker-independent filters (IFs), and additionally two loudspeaker-dependent filters (DFs) are also needed for each loudspeaker. (Note that this is a special case of the DSP scheme illustrated in FIG. 6*a*.)
Figure 8:
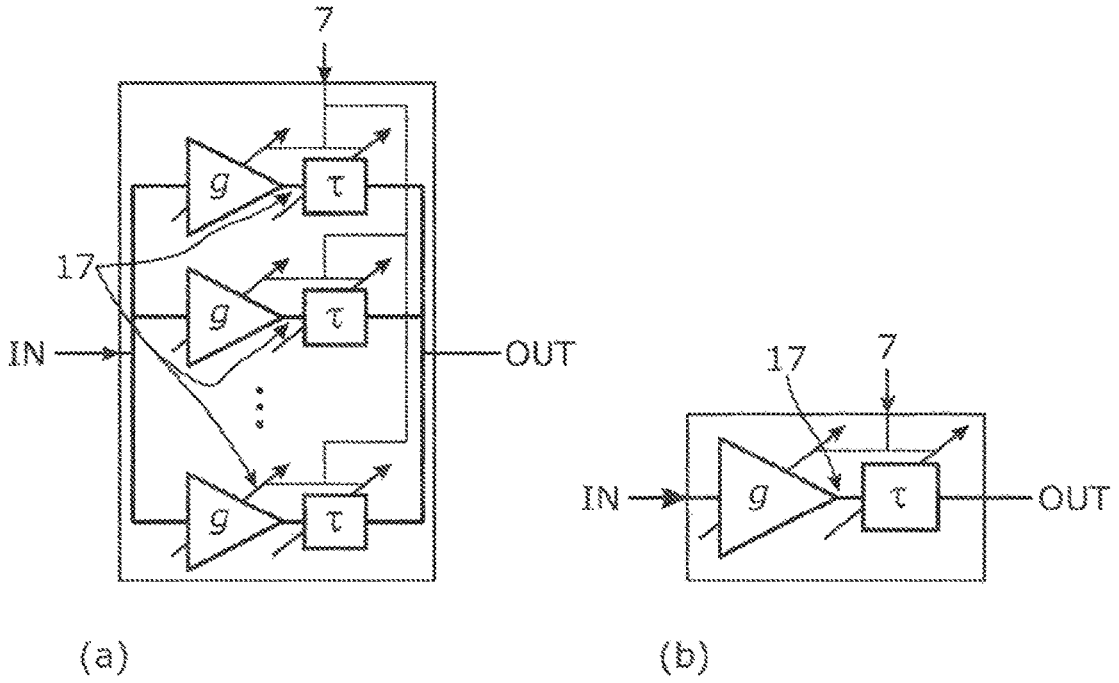
FIG. 8*a* illustrates the structure of one of the loudspeaker-independent filters (IFs) as those shown in FIGS. 6*b* and 7*b*, which is constituted by a bank of parallel delay and gain elements.
FIG. 8*b* illustrates the structure of one of the loudspeaker-dependent filters (DFs) as those shown in FIGS. 6*b* and 7*b*, which comprises a gain and a delay element.

The loudspeaker-dependent filters are expressed as $$DF_{nl} = g_{nl}\delta(t+\tau_{nl}-T), \tag{6}$$

where $g_{nl}$ may be chosen as $c_{nl}$ and $\tau_{nl}=r_{nl}/C_0$ These are implemented by a single gain-delay element 17, as that illustrated in FIG. 8*b*, which is controlled in real-time by the filter coefficients information 7. It is possible to have a set of NL loudspeaker-dependent filters for each beam generator, as shown in FIG. 7. However, since the loudspeaker-dependent filters are the same for each beam generator, it is possible to simplify the signal processing by using a set of loudspeaker-independent filters that is common to all beam generators, thus having a total of NL loudspeaker dependent filters. This is shown in FIGS. 9 and 10. In FIG. 9 the generalised case is shown, and in FIG. 10 the case of a two beam scenario is shown. In each case a single set of speaker-independent filter elements is advantageously provided for all beams.

For the specific case in which the loudspeaker array operates in 'personal audio' mode with 2 listeners or in 'binaural' mode with a single listener, as in the DSP scheme of FIG. 7*b*, the time domain expression for the loudspeaker-independent filters, IFs, 10 and the loudspeaker-dependent filters 12 can be obtained in a simpler, direct, way. This is desirable, because it can be used to program the filter coefficient calculator block 6 in a very efficient manner. The impulse responses of the loudspeaker-independent filters 10 can be expressed in the time domain as:

$$IF_{11}=\alpha_{11}\delta(t-T), \tag{7}$$

$$IF_{12}=\alpha_{12}\delta(t-[\tau_{1b}-\tau_{2b}-T]), \tag{8}$$

$$IF_{21}=\alpha_{21}\delta(t-[\tau_{2b}-\tau_{1b}-T]), \tag{9}$$

and $$IF_{22}=\alpha_{22}\delta(t-T). \tag{10}$$

where T is a modelling delay.

It is possible to choose the following quantities to be $$a_{11}=\left(\frac{|c_2|+\beta}{A_T}\right), \tag{11}$$

$$a_{12}=-A_T^{-1}\sum_{b=1}^{L}c_{1b}c_{2b}, \tag{12}$$

$$a_{21}=-A_T^{-1}\sum_{b=1}^{L}c_{2b}c_{1b}, \tag{13}$$

and $$a_{22}=\left(\frac{|c_1|+\beta}{A_T}\right), \tag{14}$$

where $A_T=|c_1||c_2|+\beta(|c_1|+|c_2|)+\beta^2$. These expressions, which are updated in real-time by the filter coefficient calculator 6, give the filter coefficients 7 used to populate the different delay-gain elements for the delay-gain elements 17 of the independent filters shown in FIG. 8*a*.

For the DSP diagram shown in FIG. 7*b* the equalisation filter, EQ, 9 can be implemented as an FIR or an IIR filter. The coefficients of the equalisation filter can be calculated from the determinant, det $(CC^H+\beta I)$, and can be updated in real-time depending on the listener position.

The impulse responses of the loudspeaker-dependent filters are expressed in the time domain as $$DF_{1l}=b_{1l}\delta(t+\tau_{1l}-T), \tag{15}$$

and $$DF_{2l}=b_{2l}\delta(t+\tau_{2l}-T), \tag{16}$$

where it is possible to choose $b_{1l}=c_{1l}$ and $b_{2l}=c_{2l}$. These impulse responses are implemented using loudspeaker-dependent filter arrangements as shown in FIG. 8*b* constituted by a gain-delay element 17.

In contrast to the known approaches, the above sound production techniques advantageously calculate the filters for the loudspeaker arrays using a time domain approach, which can obtain the filter coefficients in real-time for each listener position. This requires a simpler, less-demanding signal processing scheme and does not limit the range of movements of the listener to the size of the measurement grid.

REFERENCES

[1] S. Atal and R. Schroeder, 'Apparent sound source translator,' Patent, Feb. 22, 1966, U.S. Pat. No. 3,236,949. [Online].

[2] H. Hamada, O. Kirkeby, P. Nelson, and F. Orduna-Bustamante, 'Sound recording and reproduction systems,' Patent, Feb. 29, 1996, WO Patent App. PCT/GB1995/002,005.

[3] P. Nelson and T. Takeuchi, 'Optimal source distribution,' Sep. 27 2005, U.S. Pat. No. 6,950,524.

[4] J. Bauck, 'Transaural stereo device,' Patent, Jan. 23, 2007, U.S. Pat. No. 7,167,566.

[5] C. Kuhn, R. Pellegrini, M. Rosenthal, and E. Corteel, 'Method and system for producing a binaural impression using loudspeakers,' Patent, Sep. 18, 2012, U.S. Pat. No. 8,270,642.

[6] Y. Li, 'Generation of 3d sound with adjustable source positioning,' Patent, Apr. 19, 2012, U.S. patent application Ser. No. 12/925,121.

[7] A. Hooley, P. Windle, and E. CHOUEIRI, 'Array loudspeaker system,' Jul. 17 2013, EP Patent App. EP20, 110,752,332.

[8] F. Fazi, S. Kamdar, P. Otto, and Y. Toshiro, 'Method for controlling a speaker array to provide spatialized, localized, and binaural virtual surround sound,' May 24 2012, WO Patent App. PCT/US2011/060,872.

[9] T. Hooley and R. Topliss, 'Loudspeaker with position tracking of a listener,' Feb. 16 2012, WO Patent App. PCT/GB2011/000,609.

[10] P. Mannerheim, P. Nelson, and Y. Kim, 'Method and apparatus for tracking listener's head position for virtual stereo acoustics,' Dec. 11 2012, U.S. Pat. No. 8,331,614.

[11] O. Kirkeby, P. A. Nelson, H. Hamada, and F. Orduña Bustamante, 'Fast deconvolution of multichannel systems using regularization,' IEEE Transactions on Audio Speech and Language Processing, vol. 6, no. 2, 1998.

[12] M. F. Simon Gálvez, S. J. Elliott, and J. Cheer, 'A super directive array of phase shift sources,' The Journal of the Acoustical Society of America, vol. 132, no. 2, pp. 746-756, 2012.

The invention claimed is:

1. A sound reproduction system comprising:

an array of loudspeakers, a signal processor which determines input signals to the loudspeaker array, a listener position tracker arranged to sense a listener's instantaneous position relative to the loudspeaker array, wherein the signal processor is configured to apply a filter set to a sound recording to be output by the loudspeaker array, so as to determine the loudspeaker input signals, wherein the signal processor is further configured to determine updated operational control parameters of the filter set, based at least in part on the instantaneous position of a listener as determined by the listener position tracker, and to adaptively tailor the operational control parameters of the filter set accordingly, and wherein the filter set comprises a plurality of delay-gain filter elements, wherein the filter set comprises a plurality of loudspeaker-specific filter elements, which are each associated with different respective speakers of the loudspeaker array, and a plurality of loudspeaker-independent filter elements, which are each common to a plurality of the loudspeakers of the array, and wherein the updated operational control parameters are tailored for both the loudspeaker-specific filter elements and the loudspeaker-independent filter elements.

2. The sound reproduction system of claim 1, wherein the sound reproduction system is arranged to determine a value or a set of values which are used to update the operational parameters of the filter set.

3. The sound reproduction system of claim 1, wherein the filter set comprises or constitutes a number of acoustic beam generators, each arranged to control the speakers to output multiple acoustic beams.

4. The sound reproduction system of claim 3, wherein the steering direction of the acoustic beams produced is arranged to be varied in response to sensed listener positioning relative to the loudspeaker array.

5. The sound reproduction system of claim 3, wherein the beam generators are arranged to generate acoustic beams which deliver binaural audio signals to one or more listeners.

6. The sound reproduction system of claim 3, wherein the beam generators are arranged to control reproduced pressure at the ears of at least one listener taking account of sensed listener positioning.

7. A signal processing apparatus, for providing input signals to a loudspeaker array, comprising a filter set that includes a plurality of delay-gain filter elements, wherein the plurality of delay-gain filter elements includes:

(a) a plurality of loudspeaker-specific filter elements which are each associated with different respective speakers of the loudspeaker array, and (b) a plurality of loudspeaker-independent filter elements which are each common to a plurality of the loudspeakers of the array.

8. The signal processing apparatus of claim 7, wherein the filter set comprises or constitutes a number of acoustic beam generators, each arranged to control the speakers to output multiple acoustic beams.

9. The signal processing apparatus of claim 8, wherein the beam generators are arranged to generate acoustic beams which deliver binaural audio signals to one or more listeners.

10. The signal processing apparatus of claim 8, wherein the beam generators are arranged to deliver different audio to different respective listeners.

11. The signal processing apparatus of claim 7, further comprising an equalisation filter comprising at least one of a non-adaptive Finite Impulse Response, FIR, filter or an Infinite Impulse Response, IIR, filter.

12. The signal processing apparatus of claim 7, further comprising an equalization filter comprising at least one of an adaptive Finite Impulse Response, FIR, filter or an Infinite Impulse Response, IIR, filter.

13. The signal processing apparatus of claim 7, wherein the filter set comprises Head Related Transfer Function, HRTF, compensation Finite Impulse Response, FIR, filters arranged to flatten the reproduced pressure at listeners' ears.

14. The signal processing apparatus of claim 7, wherein the processor is arranged to determine instantaneous solutions of an underlying inverse problem.

15. The signal processing apparatus of claim 7, wherein each of the loudspeaker-specific filters comprises of a delay and gain element.

16. The signal processing apparatus of claim 7, wherein a group of loudspeaker-specific filter elements are arranged to be common to least two or all generated audio beams.

17. The signal processing apparatus of claim 16, wherein the number of loudspeaker-specific filters is LN, where L is the number of speakers, and N is the number of audio beams.

18. A sound reproduction system comprising the signal processing apparatus of claim 7.

19. The signal processing apparatus of claim 7, wherein the apparatus is configured to determine and tailor operational control parameters of the loudspeaker-specific filter elements and the loudspeaker-independent filter elements.

20. A non-transitory computer readable medium containing instructions, which, when executed by a data processor, are arranged to implement signal processing of a sound reproduction system such that it is configured to apply a filter set to a sound recording, to be output by a loudspeaker array, so as to determine the loudspeaker input signals, wherein the instructions are further configured to determine updated operational control parameters of the filter set, based at least in part on the instantaneous position of a listener as determined by listener position tracking data, and to adaptively tailor the operational control parameters of the filter set accordingly, wherein the filter set comprises a plurality of delay-gain filter elements, and wherein the filter set comprises a plurality of loudspeaker-specific filter elements which are each associated with different respective speakers of the loudspeaker array, wherein a plurality of loudspeaker-independent filter elements which are each common to a plurality of the loudspeakers of the array, and wherein the updated operational control parameters are tailored for both the loudspeaker-specific filter elements and the loudspeaker-independent filter elements.

* * * * *